US006877394B2

(12) United States Patent
Massey, III et al.

(10) Patent No.: US 6,877,394 B2
(45) Date of Patent: Apr. 12, 2005

(54) ADJUSTABLE VEHICLE THROTTLE PEDAL AND METHOD

(75) Inventors: William G. Massey, III, Portland, OR (US); Nasser Zamani, Lake Oswego, OR (US)

(73) Assignee: Freightliner LLC, Portland, OR (US)

( * ) Notice: Subject to any disclaimer, the term of this patent is extended or adjusted under 35 U.S.C. 154(b) by 76 days.

(21) Appl. No.: 10/020,525

(22) Filed: Dec. 14, 2001

(65) Prior Publication Data

US 2003/0110879 A1 Jun. 19, 2003

(51) Int. Cl.[7] ..... G05G 1/14
(52) U.S. Cl. ..... 74/512; 74/560
(58) Field of Search ..... 74/512, 513, 514, 74/560, 562

(56) References Cited

U.S. PATENT DOCUMENTS

| | | | | | |
|---|---|---|---|---|---|
| 2,123,299 | A | | 7/1938 | Gibbons, Jr. et al. | |
| 2,382,918 | A | * | 8/1945 | Rubissow | 74/513 |
| 3,059,960 | A | | 10/1962 | Komorowski et al. | |
| 3,164,031 | A | | 1/1965 | Rubissow | |
| 3,178,962 | A | | 4/1965 | Peras | |
| 3,181,666 | A | * | 5/1965 | Dow | 477/193 |
| 3,288,239 | A | | 11/1966 | Ristau | |
| 3,630,326 | A | | 12/1971 | Kawaguchi | |
| 3,643,524 | A | * | 2/1972 | Herring | 74/512 |
| 3,943,795 | A | * | 3/1976 | Kenney | 74/562.5 |
| 4,976,166 | A | | 12/1990 | Davis et al. | |
| 5,063,811 | A | | 11/1991 | Smith et al. | |
| 5,133,225 | A | | 7/1992 | Lundberg et al. | |
| 5,497,677 | A | * | 3/1996 | Baumann et al. | 74/513 |
| 5,507,201 | A | * | 4/1996 | Fairbairn et al. | 74/513 |
| 5,558,601 | A | | 9/1996 | Naruse | |
| 5,583,407 | A | | 12/1996 | Yamaguchi | |
| 5,761,967 | A | * | 6/1998 | Papenhagen et al. | 74/513 |
| 6,019,015 | A | | 2/2000 | Elton | |
| 6,132,313 | A | | 10/2000 | Yamaguchi | |
| 6,301,993 | B1 | * | 10/2001 | Orr et al. | 74/512 |
| 2002/0053254 | A1 | * | 5/2002 | Rixon et al. | 74/560 |

* cited by examiner

*Primary Examiner*—David A. Bucci
*Assistant Examiner*—Bradley J. Van Pelt
(74) *Attorney, Agent, or Firm*—Klarquist Sparkman LLP

(57) ABSTRACT

An adjustable foot pedal assembly for a vehicle, according to one disclosed embodiment, comprises a foot pedal supported by a base. The pedal is mounted in a position generally above the base, with the lower end of the pedal pivotally connected to the lower end of the base. The first end of a lever arm is pivotally mounted on the lower surface of the pedal and the second end of the lever arm is positioned for movement relative to the upper surface of the base when the pedal is pivoted toward and away from the base between a depressed position and an idle position. An adjustment mechanism may couple the upper end portion of the base to a wall of a vehicle and is configured to selectively vary the fore and aft position of the base and the pedal from the wall.

36 Claims, 2 Drawing Sheets

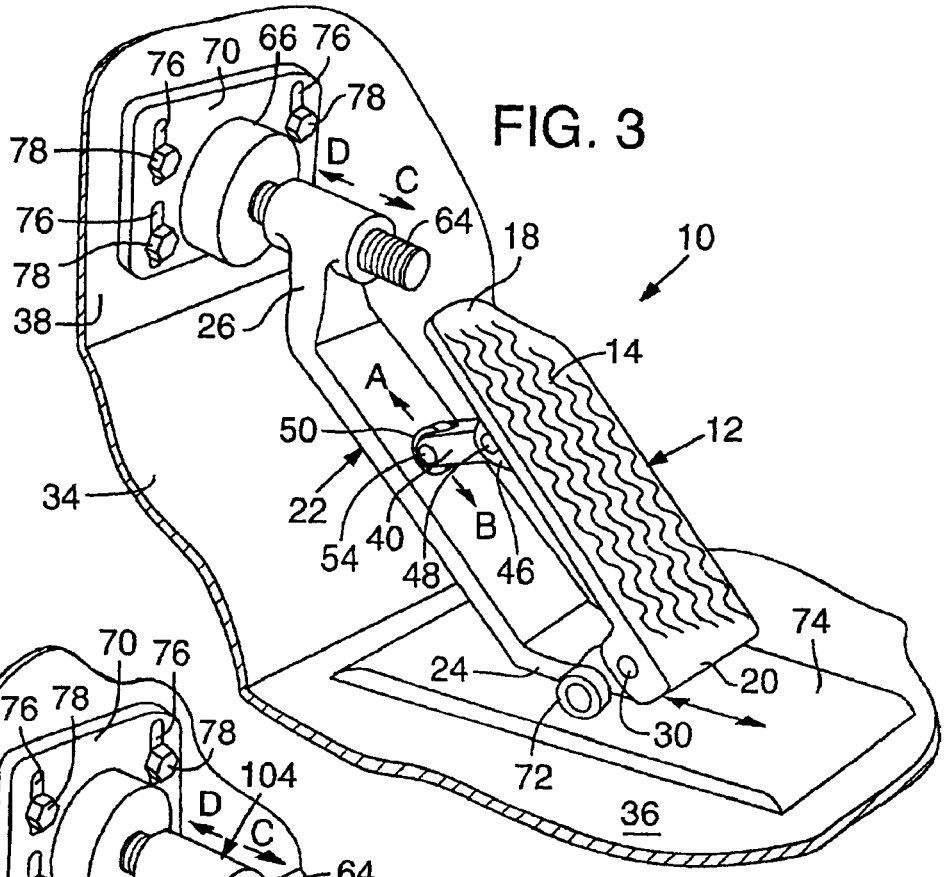
FIG. 3
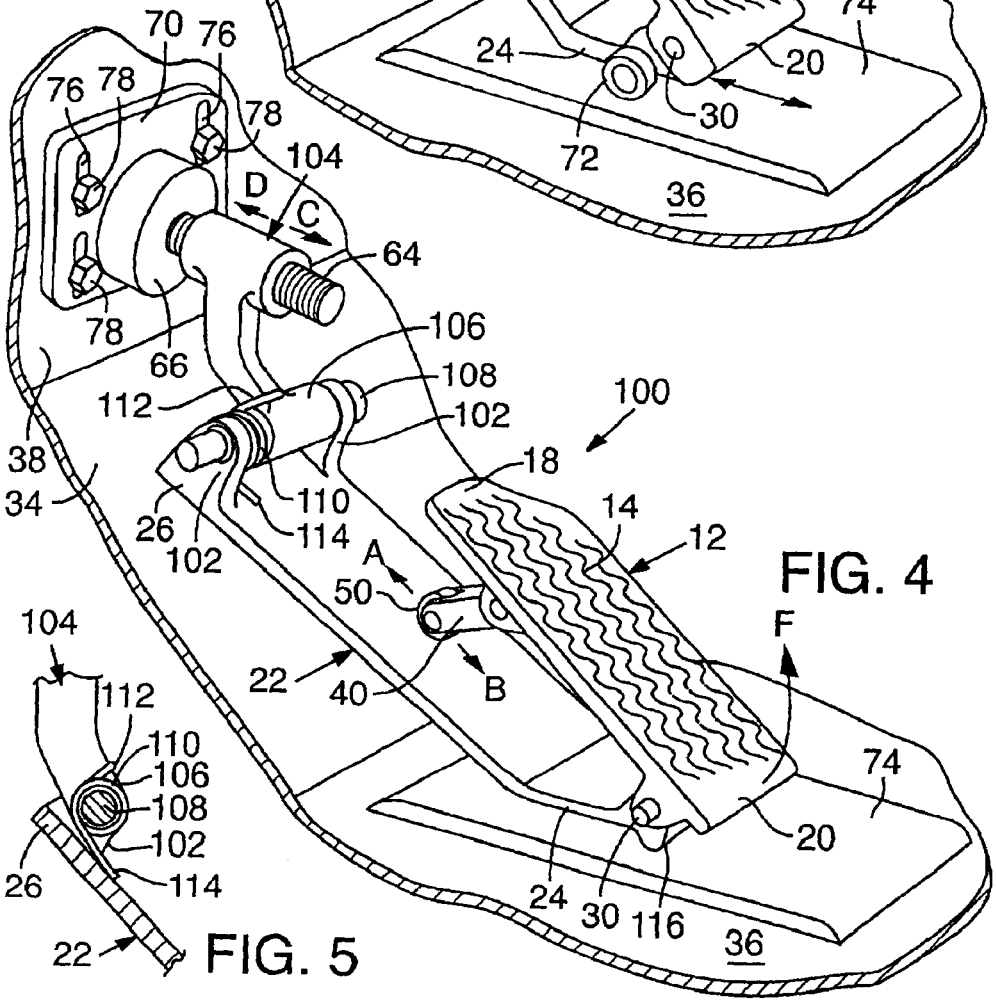
FIG. 4
FIG. 5

ADJUSTABLE VEHICLE THROTTLE PEDAL AND METHOD

FIELD

The present invention relates to adjustable foot pedals for vehicles.

BACKGROUND

Vehicle pedals, such as accelerator pedals, which have specific support mechanisms allowing them to be adjusted to various positions closer to or farther away from the driver are known. For example, U.S. Pat. No. 3,288,239 to Ristau, which is understood to disclose an adjustable toe board on which a brake pedal and an accelerator pedal are mounted. The toe board is adjustable fore and aft, relative to the driver, along a threaded shaft mounted in parallel with the steering column.

Another example of an adjustable pedal is described in U.S. Pat. No. 6,019,015 to Elton. This patent is understood to disclose an adjustable pedal assembly comprising a pedal lever having an upper end pivotally connected to the lower end of a support arm. The upper end of the support arm is pivotally mounted to the wall of a vehicle. A ballscrew mounted to the vehicle wall threadably engages a nut carried by the support arm so that rotation of the ballscrew causes the support arm and the pedal to pivot relative to the vehicle wall. By making the support arm of substantial length and limiting its angular adjustment motion, the height of the pedal above the floor is maintained relatively constant over the range of adjustment of the pedal.

A need exists for a new and improved adjustable foot pedal apparatus and method for a vehicle.

SUMMARY

The present invention is directed toward new and nonobvious aspects and features of an adjustable foot pedal assembly for a vehicle, both alone and in various combinations and sub-combinations with one another, which are set forth in the claims below. A unique and nonobvious pedal support structure also is disclosed. In addition, unique and nonobvious pedal adjustment methods are disclosed herein.

According to one representative embodiment, an adjustable foot pedal assembly for a vehicle comprises a foot pedal having an upper foot engageable major surface and a lower major surface which may be opposed to the upper surface. The pedal is carried by a pedal support portion and desirably has an upwardly angled upper major surface. An adjustment mechanism is provided for desirably coupling the pedal support portion to a wall, such as an upright wall, of a vehicle. The adjustment mechanism is desirably configured to selectively vary the fore and aft position of the pedal support portion, and thereby the pedal, relative to the vehicle wall. The adjustment mechanism may also be selectively vertically adjustable along the wall to vary the elevation of the pedal relative to the vehicle floor. The elevation of the pedal may be independently adjustable of any adjustment of the fore and aft position of the pedal support portion and the pedal. In one specific example, the height of the pedal above the vehicle floor can be adjusted while maintaining the fore-aft or horizontal distance between the pedal and the driver. Similarly, the horizontal or fore-aft distance between the pedal and the driver can be adjusted while maintaining a constant height of the pedal above the vehicle floor.

In an alternative embodiment, the pedal support portion may comprise plural segments which are desirably pivotally interconnected. In one form, the segments pivot about a transverse pivot axis which is perpendicular to the fore-aft direction. In this case, raising or lowering the pedal support portion may result in some shifting of the pedal in the fore-aft direction and slight adjustment of the angle of the pedal relative to the vehicle wall due to the pivoting of the segments relative to one another as the elevation is changed. Nevertheless, the elevation adjustment can desirably be made independently of fore-aft adjustment of the pedal using a fore-aft adjustment mechanism which couples the pedal support to the vehicle.

In one specific implementation, the lower end portion of the pedal is pivotally connected to a lower end portion of the pedal support portion. The first end of a lever arm is pivotally coupled to the pedal, such as to the lower major surface of the pedal. The second end of the lever arm may be positioned to move along a bearing surface of the pedal support portion upon pivoting of the pedal toward and away from the pedal support portion between a depressed position and an idle position, respectively. To facilitate movement of the second end of the lever arm along the surface of the pedal support portion, a roller may be rotatably mounted to the second end of the lever arm for rolling contact along the pedal support bearing surface when the pedal is pivoted toward and away from the pedal support portion. In addition, a biasing element, such as a spring or other resilient member, may be interposed between the pedal and pedal support portion to urge the pedal toward the idle position.

The adjustment mechanism according to one illustrated form comprises a mechanism coupled to the support so as to permit shifting of the support toward and away from a wall of the vehicle. One exemplary form of an adjustment mechanism comprises a rotatable screw configured to be mounted to the wall of the vehicle. A carrier bracket threadably engages the screw and is coupled to the upper end portion of the pedal support portion. The carrier bracket may comprise a separate component or may be combined with other portions of the pedal support in a one-piece monolith construction. In this example, rotation of the screw in a first direction causes the carrier bracket to move the pedal support portion and the pedal away from the wall and rotation of the screw in a second direction, opposite the first direction, causes the carrier bracket to move the pedal support portion and the pedal toward the wall. Although less desirable, other axial shifting mechanisms, such as a carrier bracket adapted for sliding movement along a track, may be used to accomplish fore-aft shifting of the pedal support mechanism.

In an alternative configuration, the upper end portion of the pedal support portion may be pivotally coupled to, or, alternatively, pivotally mounted directly to the carrier bracket for pivoting of the pedal support portion toward and away the vehicle floor. This permits, for example, raising of the pedal support for cleaning of the vehicle floor underneath the pedal assembly. An optional biasing mechanism may be provided to urge the pedal support portion toward the floor or other support surface of the vehicle.

According to another representative embodiment, an adjustable foot pedal assembly for a vehicle comprises a base having upper and lower end portions. The lower end portion of a pedal is pivotally coupled to the lower end portion of the base such that the pedal is in an upwardly inclined position generally above the base. The first end of a lever arm is pivotally coupling to the pedal, such as to lower surface of the pedal. The second end of the lever arm is positioned for coupling to, or contact with the base and is caused to move along the base when the pedal is pivoted toward and away from the base between a depressed position and an idle position, respectively. This contact may be direct contact or indirect contact through the use of a roller mounted to the second end of the lever arm. An adjustment mechanism is desirably provided for coupling the upper end portion of the base to a wall of a vehicle. The adjustment mechanism in one form allows adjustment of the position of the pedal in a first direction toward the driver and in a second direction away from the driver.

According to yet another representative embodiment, an adjustable foot pedal assembly comprises a pedal support portion having an upper end portion positioned proximate a wall of the vehicle and a lower end portion positioned proximate a lower or floor surface of the vehicle. A foot pedal is carried by the pedal support portion. An adjustment mechanism is mounted to the wall of the vehicle. The upper end portion of the pedal support portion may be pivotally coupled to the adjustment mechanism so as to permit pivoting of the lower end portion of the pedal support portion toward and away from the floor surface of the vehicle. The adjustment mechanism also is desirably operable to selectively vary the fore and aft position of the pedal support portion, and thereby the pedal, relative to the wall of the vehicle.

According to another representative embodiment, an adjustable foot pedal assembly for a vehicle comprises a pedal support portion and a foot pedal carried by the pedal support portion. The upper end portion of the pedal support portion is configured to be mounted for vertical movement along a vehicle wall to permit adjustment of the vertical position of the pedal assembly relative to the floor of the vehicle. In one specific implementation, a mounting bracket is coupled to the upper end portion of the pedal support portion. The mounting bracket may be configured to be slidably mounted to the vehicle wall. More specifically, the mounting bracket in one form defines at least one vertically extending slot for receiving a releasable fastener, such as a mounting bolt. The bolt extends through the slot and is tightened into the wall to secure the mounting bracket against the wall at a selected vertical position. The mounting position of the bracket may be adjusted by loosening the bolt, sliding the bracket to a desired position and re-tightening the bolt.

BRIEF DESCRIPTION OF THE DRAWINGS

FIG. 3 is a perspective view of the throttle pedal assembly of FIG. 1.

FIG. 4 is a perspective view of a throttle pedal assembly according to another embodiment.

FIG. 5 is a partial, sectional side view of the lower end portion of the carrier bracket and the upper end portion of the base of the pedal assembly of FIG. 4, showing one form of a biasing spring for urging the base toward the vehicle floor.

DETAILED DESCRIPTION

Figure 1:
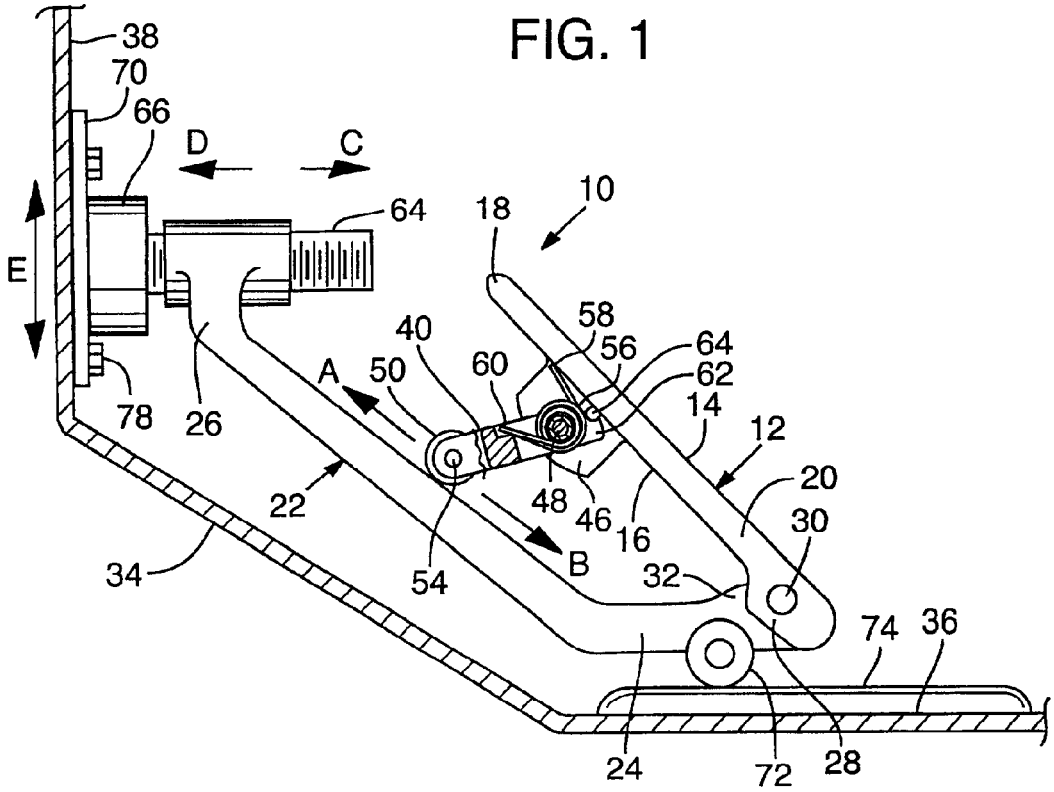
FIG. 1 is a side elevation view of a throttle pedal assembly according to one embodiment, showing a portion of a lever arm in section.
Figure 2:
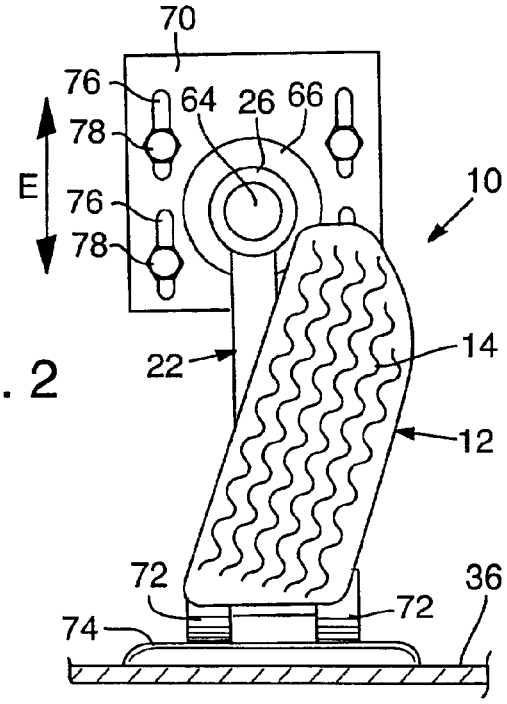
FIG. 2 is a front elevation view of the throttle pedal assembly of FIG. 1.

Referring first to FIGS. 1–3, there is shown a foot pedal assembly 10 for a vehicle according to one embodiment. The foot pedal assembly 10 in the present example comprises a throttle, or an accelerator, pedal assembly for controlling the speed of the vehicle. However, in other applications, assembly 10 may comprise other types of vehicle pedals, such as a brake pedal or a clutch pedal. As best shown in FIGS. 1 and 3, the pedal assembly 10 is desirably installed in a vehicle enclosure (e.g., a truck cab or driver compartment) that includes a generally vertical front wall 38, a generally horizontal floor 36 and an inclined toe board 34 extending between the wall 38 and the floor 36.

The foot pedal assembly 10 comprises a foot pedal 12 having a foot engageable upper major surface 14 and a lower major surface 16 which may oppose the surface 14. The pedal 12 also has an upper end portion 18 and a lower end portion 20. A suitable gripping surface may be provided on the upper surface 14 of the pedal 12 to minimize slippage of an operator's foot (as best shown in FIG. 2).

A pedal support portion, such as a base 22 in the illustrated embodiment, supports pedal 12. An upper end 26 of base 22 is mounted to the front wall 38, as described in greater detail below. Base 22 may be of a plate-like configuration. As best shown in FIG. 1, the lower end portion 20 of the pedal 12 is pivotally connected to a lower end portion 24 of the base 22. The lower end portion 20 of the pedal 12 in this example comprises a pair of downwardly extending spaced apart projections 28 and the lower end portion 24 of the illustrated base 22 comprises a pair of upwardly extending spaced apart projections 32. A pivot pin 30 extends through holes in the projections 28 of the pedal 12 and corresponding holes in the projections 32 of the base 22 for pivotably mounting the pedal 12 in a position generally above the base 22. As best shown in FIG. 2, the pedal 12 may have a longitudinal axis which is skewed or angled slightly with respect to the longitudinal axis of the base 22, although in other embodiments, the axes may be aligned.

The base 22 may be shaped to correspond to the shape of the vehicle enclosure in which it is installed. As shown in FIGS. 1 and 3, for example, an intermediate portion of base 22, extending between lower and upper ends 24, 26, is supported at an angle with respect to the floor 36 and the wall 38 so as to generally correspond to the slope of the toe board 34. The lower end portion 24 of the base 22 may angle from the intermediate portion so that it is generally parallel to the floor 36 of the vehicle. The upper end portion 26 of the base 22 may extend vertically upward from the intermediate portion in a direction generally parallel to the wall 38. It should be understood, however, that the shape of base 22 may be varied as needed to accommodate different vehicle enclosures or as otherwise desired.

Any suitable mechanism may be used to determine the position of the pedal 12 and communicate the position to the throttle of the engine (not shown) for controlling the speed of the vehicle. For example, the pedal assembly 10 may be operable to output an electrical signal to an engine controller that is proportional to the degree the foot pedal 12 is pivoted relative to the base 22. In the illustrated embodiments, for example, the pedal position may be detected and indicated using a lever arm, or lever mechanism 40 (also referred to herein in alternative embodiments as an arm member or pivot support member) with an electrical signal from a suitable pedal position sensor, such as a potentiometer (not shown), operatively coupled to the lever arm 40. As shown in FIGS. 1 and 3, the lever arm 40 has a first end pivotally coupled to the pedal 12, such as to the lower surface 16 of the pedal 12 in the illustrated configuration. A second end of arm 40 may be coupled to the base, such as to the upper surface of the base 22, so as to be movable relative to the base 22 upon pivoting of the pedal 12 relative to the base 22. The first end of lever arm 40 may be positioned between and pivoted to spaced apart downwardly projecting ears 46 on the lower surface 16 of the pedal 12. A pin 48 extends through pin receiving holes in ears 46 and a corresponding hole in the first end of the lever arm 40. The potentiometer (not shown), which is operable to output a signal that is proportional to the degree the pedal is pivoted relative to the base, may be mounted to the pivot pin 48.

A biasing mechanism is desirably provided to urge the pedal 12 to an idle position, such as shown in FIG. 1, in which the angle between the pedal 12 and the base 22 is greatest. In the illustrated embodiment, for example, the biasing mechanism comprises a torsional spring 56 carried by pin 48 (FIG. 1). In this example, a first end 58 of spring 56 abuts against the bottom surface 14 of pedal 12 and a second end 60 of spring 56 abuts against the lever arm 40. In this manner, the biasing force of the spring 56 urges the second end of the lever arm to pivot in a direction away from the upper end portion 18 of the pedal 12. Leaf springs, compression members, resilient pads or other suitable biasing members also may be used.

Upon application of downward pressure on the upper surface 14 of the pedal 12 to cause pivoting of the pedal 12 toward the upper surface of the base 22, the second end of the lever arm 40 pivots toward the upper end portion 18 of the pedal 12 as it moves upwardly along the upper surface of the base 22 (as indicated by arrow A in FIG. 1). Upon release of the downward pressure, the spring 56 urges the second end of the lever arm 40 to pivot away from the bottom surface 14 of the pedal upper end portion and move along the base 22 in a downward direction (as indicated by arrow B in FIG. 1). Movement of the lever arm 40 in the B direction causes the pedal 12 to pivot away from the base 22 to the idle position. The pivotal motion of the lever arm 40, in the direction urged by spring 56, may be limited by a stop. For example, a projection 62 of the lever arm 40 may engage a motion limiting projection 64 extending from the bottom surface 16 of the pedal 12 (as shown in FIG. 1).

If desired, more than one biasing member, such as plural springs may be used, to provide a redundant bias so that if one biasing member is disabled, the pedal 12 is urged toward the idle position by the backup biasing member. In an alternative embodiment, the spring 56 is carried by pivot pin 30, rather than pivot pin 48, with one end of the spring abutting the bottom surface 16 of the pedal 12 and the other end of the spring abutting the upper surface of the base 22.

In addition, other forms of biasing mechanism also may be used. For example, in one embodiment a flat, spirally wound ribbon-type spring may be positioned around pin 48. In this configuration, an outer end of the spring engages a projection on the bottom surface of the pedal and an inner end of the spring is connected to the pin.

The electronics for generating an output control signal to the engine controller are conventional. For example, as previously mentioned, a potentiometer (not shown) may be mounted to pivot pin 48, although other electronic devices may be used for the purpose of generating an output control signal to the engine controller.

Although not required, a shaft or roller 50 may be rotatably mounted to the second end of the lever arm for rolling contact with the upper surface of the base 22, as shown in FIGS. 1 and 3. In this case, the second end of the lever arm 40 indirectly contacts the upper surface of the base 22. As shown, the roller 50 in the form shown is positioned between downwardly projecting ears formed on the second end of the lever arm 40. The roller, if used, may otherwise be coupled to the arm. A pin 54 extends through the ears and a centrally located hole extending through the roller 50. If a roller is not used, the second end of the lever arm 40 may, for example, be covered with a low friction material to minimize sliding friction on the base 22.

In addition, other mechanisms may be used to determine the position of the pedal and communicate the position to the throttle of the engine. For example, instead of providing an electrical signal for controlling vehicle speed, the pedal assembly 10 may be adapted for use in vehicles in which vehicle speed is mechanically controlled, for example, by adjusting the position of a throttle cable. By way of example, in one embodiment, a pedal is pivotally mounted to a base, such as shown in FIGS. 1–3. A lever arm is pivotally mounted to the base intermediate the first and second ends of the lever arm. The first end of the lever arm is positioned to moveably engage a bottom surface of the pedal. The second end of the lever arm, positioned below the base, is coupled to a throttle cable. Pivoting of the pedal toward and away from the base causes pivoting of the lever, which in turn causes movement of the throttle cable.

In alternative embodiments, the pedal position may be detected and indicated using a four-bar, or parallelogram, linkage assembly or a sliding member in cooperation with a suitable pedal position sensor, such a potentiometer, or alternatively, a throttle cable.

The position of the pedal 12 may be adjusted to accommodate drivers of various leg lengths. Although not required, the pedal assembly 10 desirably has at least two degrees of freedom for adjusting the position of the pedal. Specifically, the general fore and aft position of the pedal 12 relative to the wall 38 and the height of the pedal above the floor 36 can be adjusted. As used herein, "fore and aft" refers to movement in directions generally toward and away, respectively, from the wall 38 of the vehicle. "Fore and aft" movement may include movement of the pedal 12 along a line that is normal to the wall 38 or movement of the pedal 12 along a line that extends at an angle with respect to a line that is normal to the wall 38.

For fore and aft adjustment of the pedal 12, an adjustment mechanism (also referred to herein as a pedal position mover or fore-aft position adjuster) in one example is configured to selectively vary the fore and aft position of the base 22, and thereby the pedal 12, relative to the wall 38. The adjustment mechanism may also serve to couple the upper end portion 26 of the base 22 to the vehicle wall 38. As best shown in FIGS. 1 and 3, for example, the adjustment mechanism in one illustrated form comprises a drive mechanism 66 coupled to a rotatable jack screw 64. The drive mechanism 66 may comprise, for example, a DC motor directly coupled to the screw 64, although other forms for the drive mechanism also may be used. For example, a motor may be gear coupled to the screw 64. The drive mechanism 66 in the illustrated form is mounted to a mounting bracket 70 that is in turn, mounted to the wall 38 of the vehicle. The upper end portion 26 of the base 22 may comprise or form a carrier bracket (also called a bracket member or carrier member) that threadably engages the screw 64.

The screw 64 is selectively rotatably driven by the drive mechanism 66 to cause movement of the carrier bracket relative to the screw 64. Rotation of the screw 64 in a first direction causes the carrier bracket to carry the base 22 and the supported pedal 12 in a direction away from the wall 38 and toward the feet of the driver (as indicated by arrow C). Rotation of the screw 64 in a second direction, opposite the first direction, causes the carrier bracket to carry the base 22 and the pedal 12 in a direction toward the wall 38 and away from the feet of the driver (as indicated by arrow D). Although the screw 64 is shown as extending perpendicularly from the wall 38, this is not a requirement. For example, in other embodiments, the screw 64 may be angled upwardly, downwardly or sideways to provide fore and aft movement along a line that is non-perpendicular to the wall 38.

Of course, other types of adjustment mechanisms may be used to allow for such fore and aft movement of the pedal. For example, the carrier bracket can be configured for sliding movement along a shaft or track extending outwardly from the wall 38. In the latter configuration, a drive mechanism may be mounted to the carrier bracket for causing translational movement of the carrier bracket along the shaft or track. Alternatively, in any of the embodiments described herein, the adjustment mechanism may be configured for manual adjustment of the carrier bracket without the use of a drive mechanism.

Optional rollers 72 may be mounted at the lower end 24 of the base 22. The rollers 72 are positioned for rolling contact with an optional rub pad 74 (placed on the floor 36 of the vehicle) as the base 22 is moved fore and aft. Of course, if a rub pad is not provided, rollers 72 may be positioned for direct rolling contact with the floor 36.

As mentioned above, the pedal 12 can be moved in a generally vertical direction, either upwardly or downwardly (as indicated by double-headed arrow E in FIGS. 1 and 2), to selected positions above the vehicle floor 36. For such vertical movement of the pedal, the mounting bracket 70 is configured to be mountable at a plurality of positions on the vehicle wall 38. For example, as best shown in FIG. 2, the mounting bracket 70 in the illustrated form includes a plurality of vertical slots 76. A bolt 78 or other releasable fastener is received by each slot 76 and tightened into the vehicle wall 38 to secure the mounting bracket 70 to the wall. The slots 76 are dimensioned to permit sliding of the mounting bracket 70 relative to the bolts 78 when the bolts are not tightened against the mounting bracket. Thus, the mounting position of the bracket 70 can be adjusted by loosening the bolts 78, sliding the mounting bracket 70 to a desired position, and then re-tightening the bolts 78. The length of slots 76 may be varied to define the extent to which the assembly can be moved upwardly or downwardly.

Referring now to FIG. 4, there is shown a pedal assembly 100 according to another embodiment. Like elements from the embodiments of FIGS. 1–3 are represented by like numbers in FIG. 4. In the FIG. 4 embodiment, the upper end 26 of the base 22 is adapted to be pivotally mounted to a suitable support bracket so that the lower end 24 of the base 22 can be pivoted toward and away from the vehicle floor 36. For example, as shown in FIG. 4, spaced apart ears 102 project upwardly from the upper surface of the base 22. A carrier bracket 104 has a mounting arm 106 disposed between ears 102. A pivot pin 108 extends through holes defined in ears 102 and a corresponding bore extending through mounting arm 106 for pivotally mounting the base 22 to the carrier bracket 104. Thus, the lower end portion 24 of the base 22 can be lifted away from the vehicle floor, as indicated by arrow F, to permit, for example, cleaning of the floor in the area underneath the pedal assembly. Other alternative mechanisms for pivotally supporting the base or for movement in this manner also may be used.

An optional biasing mechanism may be provided to urge the lower end 24 of the base 22 in a direction toward the vehicle floor. In the FIG. 4 embodiment, for example, a torsional spring 110 is placed around the pivot pin 108 (as best shown in FIG. 5). A first end 112 of the spring 110 abuts against the mounting arm 106 of the carrier bracket 104 and a second end 114 of the spring abuts the upper surface of the base 22 so that the biasing force of the spring 110 urges the lower end of the base against the rub pad 74 or, alternatively, the vehicle floor if a rub pad is not provided. The biasing force of spring 110 desirably is sufficiently strong to ensure that the bottom surface of the lower end 24 of the base 22 remains in contact with the rub pad 74 when the vehicle is traversing rough terrain and the driver's foot is not on the pedal 12. Of course, biasing mechanisms other than torsional spring 110 may be used for the purpose of urging the lower end of the base against the vehicle floor. For example, a flat, spirally wound ribbon-type spring may be used. Leaf springs, resilient pads, or other suitable biasing members also may be used.

The rollers 72 in the embodiment of FIGS. 1–3, are replaced with a slider 116 in the FIG. 4 embodiment. As shown in FIG. 4, slider 116 extends downwardly from the bottom surface of the base lower end 24 for sliding contact with the rub pad 74. The slider 116 desirably is made of a low friction material to minimize sliding friction of the slider along the rub pad. Optionally, the rub pad may be made of a low friction material that is compatible with the material comprising the slider. As one example, one or both of the slider 116 and the rub pad 74 may be made of ultra high molecular weight polyethylene.

In the embodiments of FIGS. 1–5, a pedal assembly is mounted to a vehicle wall and at least partially supported by the vehicle floor. However, this is not a requirement. For example, in other embodiments, a pedal assembly may configured to be mounted to the vehicle wall for suspension above the vehicle floor, in which case rollers or a low friction slider would not be required. In addition, it is not a requirement that the pedal be pivotally mounted to the base. For example, in one embodiment, the upper end of the pedal may be rigidly connected to the lower end of a pedal support arm. The upper end of the support arm is pivotally coupled to the vehicle wall, such as with carrier bracket, for pivoting about a pivot axis, with the pedal suspended above the vehicle floor. When downward pressure is applied to the pedal, the lower end of the pedal pivots downwardly toward the vehicle floor about the pivot axis. A potentiometer may be mounted at the pivot axis for measuring the angular movement of the pedal and outputting a corresponding signal to the engine controller.

The present invention has been shown in the described embodiments for illustrative purposes only. The illustrated embodiments may be subject to many modifications and changes without departing from the spirit or essential characteristics of the invention. We therefore claim as our invention all such modifications as come within the spirit and scope of the following claims.

We claim:

1. An adjustable foot pedal assembly for a vehicle having a driver compartment comprising a wall and a floor, the pedal assembly comprising:

a base having upper and lower end portions;

a pedal having an upper major foot engageable surface, the pedal being pivotally coupled to the lower end portion of the base for movement between an idle position to a depressed position;

an arm member having a first end portion pivotally coupled at a first location to the pedal and a second end portion coupled at a second location to the base, the second location being below the first location when the pedal is in the idle position, the arm member being coupled to the base so as to be movable relative to the base when the pedal is pivoted toward and away from the base between the depressed position and the idle position, respectively; and an adjustment mechanism for coupling the upper end portion of the base to the wall of the vehicle, the adjustment mechanism being configured to selectively vary the fore-aft position of the base and the pedal from the wall of the vehicle.

2. The pedal assembly of claim 1, wherein the adjustment mechanism comprises a rotatable screw configured to be mounted to the wall of the vehicle and a carrier bracket threadably engaging the screw and coupled to the upper end portion of the base, wherein rotation of the screw in a first direction causes the carrier bracket to move the base and the pedal away from the wall and rotation of the screw in a second direction causes the carrier bracket to move the base and the pedal toward the wall.

3. The pedal assembly of claim 1, comprising at least one roller rotatably mounted to the arm member, the roller being positioned for rolling contact along the base when the pedal is pivoted toward and away from the base, the roller coupling the arm member to the base.

4. The pedal assembly of claim 1, comprising at least one roller which is rotatably coupled to the lower end portion of the base and positioned for supporting the base on the floor of the vehicle or a rub pad placed on the floor.

5. The pedal assembly of claim 1, wherein the upper end portion of the base is pivotally coupled to the adjustment mechanism to permit pivoting of the base toward and away from the floor of the vehicle.

6. The assembly of claim 5, further comprising a biasing mechanism operatively connected to the adjustment mechanism and the upper end portion of the base, the biasing mechanism being configured to bias the base toward the floor of the vehicle.

7. The pedal assembly of claim 1, wherein the adjustment mechanism is configured to be mounted to the vehicle wall, the adjustment mechanism being vertically adjustable with respect to the wall.

8. An adjustable foot pedal assembly for a vehicle having a driver compartment comprising a wall and a floor, the pedal assembly comprising:

a base having upper and lower end portions;

a pedal having an upper major foot engageable surface, the pedal being pivotally coupled to the lower end portion of the base;

an arm member having a first end portion pivotally coupled to the pedal and extending downwardly from the pedal, the arm member being coupled to the base so as to be movable relative to the base when the pedal is pivoted toward and away from the base between a depressed position and an idle position, respectively; and an adjustment mechanism for coupling the upper end portion of the base to the wall of the vehicle, the adjustment mechanism being configured to selectively vary the fore-aft position of the base and the pedal from the wall of the vehicle;

wherein the upper end portion of the base is pivotally coupled to the adjustment mechanism to permit pivoting of the base toward and away from the floor of the vehicle.

9. The pedal assembly of claim 8, further comprising a biasing mechanism operatively connected to the adjustment mechanism and the upper end portion of the base, the biasing mechanism being configured to bias the base toward the floor of the vehicle.

10. An adjustable foot pedal assembly for a vehicle having a driver compartment comprising a wall and a floor, the pedal assembly comprising:

a base having upper and lower end portions;

a pedal having an upper major foot engageable surface, the pedal being pivotally coupled to the lower end portion of the base;

an arm member having a first end portion pivotally coupled to the pedal and extending downwardly from the pedal, the arm member being coupled to the base so as to be movable relative to the base when the pedal is pivoted toward and away from the base between a depressed position and an idle position, respectively; and an adjustment mechanism for coupling the upper end portion of the base to the wall of the vehicle, the adjustment mechanism being configured to selectively vary the fore-aft position of the base and the pedal from the wall of the vehicle;

wherein the adjustment mechanism is configured to be mounted to the vehicle wall, the adjustment mechanism being vertically adjustable with respect to the wall.

11. An adjustable foot pedal assembly for a vehicle having a driver compartment comprising a wall and a floor, the pedal assembly comprising:

a foot pedal having an upper major foot engageable surface and an opposing lower major surface;

a pedal support portion, the pedal carried by the pedal support portion; and a pedal position mover for coupling the pedal support portion to the wall of the vehicle, the pedal position mover being configured to selectively vary the fore and aft position of the pedal support portion, and thereby the pedal, relative to the wall of the vehicle, the pedal position mover being vertically adjustable along the wall, wherein vertical adjustment of the pedal position mover can be made independently of any fore-aft adjustment of the pedal support portion and the pedal.

12. The foot pedal assembly of claim 11, wherein the pedal support portion has upper and lower end portions and the pedal has upper and lower end portions, the lower end portion of the pedal being pivotally coupled to the lower end portion of the pedal support portion, and the pedal assembly further comprising a pivot support member having a first end portion and a second end portion, the first end portion of the pivot support member being pivotally coupled to the pedal and extending from the lower major surface of the pedal, the second end portion of the pivot support member being positioned to move relative to the pedal support portion upon pivoting of the pedal toward and away from the pedal support portion between a depressed position and an idle position, respectively, and a biasing element interposed between the pedal and pedal support portion to urge the pedal toward the idle position.

13. The pedal assembly of claim 12, comprising at least one roller rotatably coupled to the lower end portion of the pedal support portion, the roller being positioned for rolling contact with the floor of the vehicle when the pedal position mover is activated to vary the fore-aft position of the pedal support portion.

14. The pedal assembly of claim 11, wherein the pedal support portion comprises an upper end portion pivotally coupled to the pedal position mover to permit pivoting of the pedal support portion toward and away from the floor of the vehicle.

15. The pedal assembly of claim 14, further comprising a biasing element for urging the pedal support portion toward the floor of the vehicle.

16. An adjustable foot pedal assembly for a vehicle having a driver compartment comprising a wall and a floor, the pedal assembly comprising:

a segmented pedal support portion having a first upper segment and a second lower segment, the upper segment being pivotally coupled to the lower segment to permit pivoting of the lower segment relative to the floor of the vehicle;

a foot pedal carried by the lower segment of the pedal support portion; and a fore-aft position adjuster carrying the upper segment of the pedal support portion and configured to be mounted to the wall of the vehicle, the fore-aft position adjuster being configured to selectively vary the fore and aft position of the pedal support portion, and thereby the pedal, relative to the wall of the vehicle;

wherein the fore-aft position adjuster is configured to be vertically adjustable along the wall to selectively vary the elevation of the upper segment of the pedal support portion, wherein the elevation of the upper segment of the pedal support portion is independently adjustable of the fore and aft position of the pedal support portion and the pedal.

17. An adjustable foot pedal assembly for a vehicle having a driver compartment comprising a wall and a floor, the pedal assembly comprising:

a segmented pedal support portion having a first upper segment and a second lower segment, the upper segment being pivotally coupled to the lower segment to permit pivoting of the lower segment relative to the floor of the vehicle;

a foot pedal carried by the lower segment of the pedal support portion;

a fore-aft position adjuster carrying the upper segment of the pedal support portion and configured to be mounted to the wall of the vehicle, the fore-aft position adjuster being configured to selectively vary the fore and aft position of the pedal support portion, and thereby the pedal, relative to the wall of the vehicle; and a biasing element interposed between the upper segment and the lower segment of the pedal support portion to urge the lower segment of the pedal support portion toward the floor of the vehicle.

18. An adjustable foot pedal assembly for a vehicle having a driver compartment comprising a wall and a floor, the pedal assembly comprising:

a segmented pedal support having a first upper segment and a second lower segment, the upper segment being coupled to the lower to permit pivoting of the lower segment relative to the floor of the vehicle about pivot axis extending through the upper segment and the lower segment;

a foot pedal carried by and pivotally coupled to the lower segment of the pedal support portion; and a fore-aft position adjuster carrying the upper segment of the pedal support portion and configured to be mounted to the wall of the vehicle, the fore-aft position adjuster being configured to selectively vary the fore and aft position of the pedal support portion, and thereby the pedal, relative to the wall of the vehicle;

wherein the fore-aft position adjuster comprises a rotatable screw for mounting to the wall of the vehicle and the upper segment of the pedal support portion comprises a carrier bracket threadably engaging the screw, wherein rotation of the screw in a first direction causes the carrier bracket to move the pedal support portion and the pedal away from the wall and rotation of the screw in a second direction causes the carrier bracket to move the pedal support portion and the pedal toward the wall.

19. An adjustable foot pedal assembly for a vehicle having a driver compartment comprising a wall and a floor, the pedal assembly comprising:

a segmented pedal support portion having a first upper segment and a second lower segment, the upper segment being pivotally coupled to the lower segment to permit pivoting of the lower segment relative to the floor of the vehicle;

a foot pedal carried by the lower segment of the pedal support portion;

a fore-aft position adjuster carrying the upper segment of the pedal support portion and configured to be mounted to the wall of the vehicle, the fore-aft position adjuster being configured to selectively vary the fore and aft position of the pedal support portion, and thereby the pedal, relative to the wall of the vehicle; and a rub pad for placement on the floor of the vehicle and a shaft rotatably mounted to the lower segment of the pedal support portion, the shaft being positioned for rolling contact on the rub pad when the fore-aft position adjuster is activated to adjust the position of the pedal support portion and pedal fore and aft relative to the vehicle wall.

20. A support for supporting a foot pedal in a vehicle driver compartment comprising a wall, a floor and an inclined toe board extending between the wall and the floor, the support comprising:

a vertical upper end portion for extending generally parallel to the wall;

a horizontal lower end portion for extending generally parallel to the floor; and an angled intermediate portion extending between the upper end portion and the lower end portion;

wherein the upper end portion is pivotally coupled to the intermediate portion so that the intermediate portion and the lower end portion can pivot toward and away from the floor.

21. The support of claim 20, further comprising a biasing element coupling the upper end portion and the intermediate portion, the biasing element urging the intermediate portion and the lower end portion toward the floor.

22. The support of claim 20, wherein the vehicle compartment further comprises a rotatable screw extending from the wall and the upper end portion comprises a carrier member configured to threadably engage the screw for adjusting the fore-aft position of the support upon rotation of the screw.

23. A support for supporting a foot pedal in a vehicle driver compartment comprising a wall, a floor and an inclined toe board extending between the wall and the floor, the support comprising:

a vertical upper end portion for extending generally parallel to the wall;

a horizontal lower end portion for extending generally parallel to the floor; and an angled intermediate portion extending between the upper end portion and the lower end portion such that the upper end portion, the lower end portion, and the intermediate portion define a shape that generally corresponds to the shape defined by the wall, the floor, and toe board;

wherein the vehicle compartment further comprises a rotatable screw extending from the wall and the upper end portion comprises a threaded bracket configured to engage the screw for adjusting the fore-aft position of the support while maintaining the elevation of the support upon rotation of the screw;

wherein the upper end portion is pivotally coupled to the intermediate portion.

24. A method for adjusting the position of a foot pedal support in a vehicle driver compartment comprising a wall and a floor, the method comprising:

adjusting the elevation of the support above the floor of the vehicle in a generally vertical direction; and adjusting the fore-aft position of the support relative to the wall of the vehicle in a generally horizontal direction independently of adjusting the elevation of the support.

25. The method of claim 24, further comprising adjusting the elevation of the support above the floor of the vehicle in a generally vertical direction while maintaining the fore-aft position of the support relative to the wall.

26. The method of claim 24, further comprising adjusting the fore-aft position of the support relative to the wall of the vehicle in a generally horizontal direction while maintaining the elevation of the support above the floor.

27. The method of claim 24, wherein adjusting the elevation of the support above the floor of the vehicle also adjusts the angle of a pedal supported by the support relative to the wall of the vehicle.

28. The method of claim 24, wherein adjusting the elevation of the support above the floor of the vehicle also adjusts the elevation of a pedal supported by the support.

29. An adjustable foot pedal assembly for a vehicle having a driver compartment comprising a wall and a floor, the pedal assembly comprising:

a base having upper and lower end portions and an upper surface;

a pedal having upper and lower surfaces and upper and lower end portions, the lower end portion of the pedal being pivotally mounted to the lower end portion of the base;

a lever arm having first and second ends, the first end being pivotally mounted on the lower surface of the pedal, the lever arm extending generally downwardly from the lower surface, the second end movably engaging the base so as to be movable along the upper surface of the base, wherein the pedal causes the second end to move relative to the base when the pedal is pivoted toward and away from the base between a depressed position and an idle position, respectively;

a mounting bracket for mounting to the wall;

a rotatable screw carried by the mounting bracket;

a carrier bracket threadably engaging the screw, the upper end portion of the base being pivotally coupled to the carrier bracket to permit pivoting of the base relative to the carrier bracket and toward and away from a bottom surface of the vehicle, and wherein the position of the base and pedal relative to the wall is adjustable upon rotation of the screw;

a biasing mechanism carried by the carrier bracket to urge the base toward the bottom surface of the vehicle; and a roller rotatably mounted to the lower end portion of the base, the roller being positioned for rolling contact on the bottom surface of the vehicle.

30. An adjustable foot pedal assembly for a vehicle having a driver compartment comprising a wall and a floor, the pedal assembly comprising:

a segmented pedal support portion having a first upper segment and a second lower segment, the upper segment being pivotally coupled to the lower segment to permit pivoting of the lower segment relative to the floor of the vehicle about a pivot axis extending through the upper segment and the lower segment;

a foot pedal carried by and pivotally coupled to the lower segment of the pedal support portion; and a fore-aft position adjuster carrying the upper segment of the pedal support portion and configured to be mounted to the wall of the vehicle, the fore-aft position adjuster being configured to selectively vary the fore and aft position of the pedal support portion, and thereby the pedal, relative to the wall of the vehicle;

wherein the fore-aft position adjuster is configured to be vertically adjustable along the wall to selectively vary the elevation of the upper segment of the pedal support portion, wherein the elevation of the upper segment of the pedal support portion is independently adjustable of the fore and aft position of the pedal support portion and the pedal.

31. An adjustable foot pedal assembly for a vehicle having a driver compartment comprising a wall and a floor, the pedal assembly comprising:

a segmented pedal support portion having a first upper segment and a second lower segment, the upper segment being pivotally coupled to the lower segment to permit pivoting of the lower segment relative to the floor of the vehicle about a pivot axis extending through the upper segment and the lower segment;

a foot pedal carried by and pivotally coupled to the lower segment of the pedal support portion; and a fore-aft position adjuster carrying the upper segment of the pedal support portion and configured to be mounted to the wall of the vehicle, the fore-aft position adjuster being configured to selectively vary the fore and aft position of the pedal support portion, and thereby the pedal, relative to the wall of the vehicle;

further comprising a biasing element interposed between the upper segment and the lower segment of the pedal support portion to urge the lower segment of the pedal support portion toward the floor of the vehicle.

32. An adjustable foot pedal assembly for a vehicle having a driver compartment comprising a wall and a floor, the pedal assembly comprising:

a segmented pedal support portion having a first upper segment and a second lower segment, the upper segment being pivotally coupled to the lower segment to permit pivoting of the lower segment relative to the floor of the vehicle about a pivot axis extending through the upper segment and the lower segment;

a foot pedal carried by and pivotally coupled to the lower segment of the pedal support portion; and a fore-aft position adjuster carrying the upper segment of the pedal support portion and configured to be mounted to the wall of the vehicle, the fore-aft position adjuster being configured to selectively vary the fore and aft position of the pedal support portion, and thereby the pedal, relative to the wall of the vehicle;

further comprising a rub pad for placement on the floor of the vehicle and a shaft rotatably mounted to the lower segment of the pedal support portion, the shaft being positioned for rolling contact on the rub pad when the fore-aft position adjuster is activated to adjust the position of the pedal support portion and pedal fore and aft relative to the vehicle wall.

33. A support for supporting a foot pedal in a vehicle driver compartment comprising a wall, a floor and an inclined toe board extending between the wall and the floor, the support comprising:

a vertical upper end portion for extending generally parallel to the wall;

a horizontal lower end portion for extending generally parallel to the floor; and an angled intermediate portion extending between the upper end portion and the lower end portion such that the upper end portion, the lower end portion, and the intermediate portion define a shape that generally corresponds to the shape defined by the wall, the floor, and toe board;

wherein the vehicle compartment further comprises a rotatable screw extending from the wall and the upper end portion comprises a threaded bracket configured to engage the screw for adjusting the fore-aft position of the support while maintaining the elevation of the support upon rotation of the screw;

wherein the upper end portion is pivotally coupled to the intermediate portion so that the intermediate portion and the lower end portion can pivot toward and away from the floor.

34. The support of claim 33, further comprising a biasing element coupling the upper end portion and the intermediate portion, the biasing element urging the intermediate portion and the lower end portion toward the floor.

35. The support of claim 33, wherein the vehicle compartment further comprises a rotatable screw extending from the wall and the upper end portion comprises a carrier member configured to threadably engage the screw for adjusting the fore-aft position of the support upon rotation of the screw.

36. An adjustable foot pedal assembly for a vehicle having a driver compartment comprising a wall and a pedal assembly support surface, the pedal assembly comprising:

pedal support means for engaging the pedal assembly support surface;

pedal pivotally coupled to the pedal support means and extending generally above the pedal support means, the pedal being operable to be pivoted relative to the pedal support means between a depressed position and an idle position;

means for biasing the pedal to the idle position;

adjustment means for adjusting the position of the pedal support means and the pedal toward and away from the wall; and roller means mounted to the pedal support means and positioned for rolling contact with the pedal assembly support surface when the adjustment means is activated to adjust the position of the pedal support means toward and away from the wall;

wherein the means for biasing the pedal to the idle position comprises an arm member having a first end portion pivotally coupled to the pedal and a second end portion having roller means positioned for rolling contact with the pedal support means.

* * * * *

UNITED STATES PATENT AND TRADEMARK OFFICE

CERTIFICATE OF CORRECTION

PATENT NO. : 6,877,394 B2
DATED : April 12, 2005
INVENTOR(S) : Massey et al.

It is certified that error appears in the above-identified patent and that said Letters Patent is hereby corrected as shown below:

Column 11,
Line 51, “pedal support having” should be -- pedal support portion having --.
Line 53, “being coupled” should be -- being pivotally coupled --.
Line 53, “lower” should be -- lower segment --.
Line 54, “about pivot” should be -- about a pivot --.

Column 16,
Line 12, “pedal” should be -- a pedal --.

Signed and Sealed this

Fourteenth Day of February, 2006

JON W. DUDAS
*Director of the United States Patent and Trademark Office*